US005195351A

United States Patent [19]

Heitze

[11] Patent Number: 5,195,351

[45] Date of Patent: Mar. 23, 1993

[54] ARRANGEMENT FOR CLAMPING AND BALANCING PRESSING TOOL CARRIERS AND CRANK HOUSING OF AN UPSETTING PRESS

[75] Inventor: Gerhard Heitze, Netphen, Fed. Rep. of Germany

[73] Assignee: SMS Schloemann-Siemag Aktiengesellschaft, Dusseldorf, Fed. Rep. of Germany

[21] Appl. No.: 787,053

[22] Filed: Nov. 4, 1991

[30] Foreign Application Priority Data

Nov. 3, 1990 [DE] Fed. Rep. of Germany ..... 4035000

[51] Int. Cl.[5] ..... B21J 9/06; B21B 15/00

[52] U.S. Cl. ..... 72/407; 72/184; 72/406; 72/452

[58] Field of Search ..... 72/406, 407, 452, 184, 72/189, 190, 206

[56] References Cited

U.S. PATENT DOCUMENTS

| | | | |
|---|---|---|---|
| 4,019,358 | 4/1977 | Frohling | 72/407 |
| 5,046,344 | 9/1991 | Ginzburg | 72/406 |
| 5,077,999 | 1/1992 | Rohde | 72/406 |

FOREIGN PATENT DOCUMENTS

| | | | |
|---|---|---|---|
| 0224333 | 5/1991 | European Pat. Off. . | |
| 1036412 | 8/1983 | U.S.S.R. | 72/184 |
| 1358200 | 6/1974 | United Kingdom | 72/189 |

*Primary Examiner*—Daniel C. Crane

*Attorney, Agent, or Firm*—Anderson Kill Olick & Oshinsky

[57] ABSTRACT

An arrangement for clamping and balancing pressing tool carriers and crank housing of an upsetting press for the width reduction of rolled material, particularly for reducing the wide of the slabs in hot-rolled wide strip breaking-down trains, with tool carriers which receive on both sides of the slab pressing tools which are movable in direction of the slab reduction by a crank drive. A middle rod system mounted in an articulated manner and guided through the crank housing is attached to the tool carrier approximately in the middle thereof. Based on the middle rod system, two outer rod systems are mounted in an articulated manner on the crank housing. The middle rod system and the outer rod systems are connected to clamping units for applying tensile loads to the rod systems. The clamping units, in turn, are rigidly connected to the transverse member of the housing post members of the upsetting stand.

9 Claims, 3 Drawing Sheets

ARRANGEMENT FOR CLAMPING AND BALANCING PRESSING TOOL CARRIERS AND CRANK HOUSING OF AN UPSETTING PRESS

BACKGROUND OF THE INVENTION

1. Field of the Invention

The present invention relates to an arrangement for clamping and balancing pressing tool carriers and crank housing of an upsetting press for the width reduction of rolled material, particularly for reducing the width of slabs in hot-rolled wide strip breaking-down trains with tool carriers which receive on both sides of the slab edges pressing tools which are movable in the direction of the slab reduction by means of a crank drive.

2. Description of the Related Art

In a flying upsetting press according to German patent application P 39 17 398.4, for reducing the width of slabs in a hot-rolled wide strip breaking-down train, pressing tools are arranged on both sides of the slab edges, wherein the pressing tools ar mounted in tool carriers. For forming a reduction drive, each pressing tool is moved together with the corresponding tool carrier in the direction of the width reduction of the slab by means of a lever system actuated by a crank drive, wherein the crank drive is arranged in a crank housing. The crank drive is composed of two driven eccentric shafts, wherein a connecting member is mounted on each eccentric shaft, and wherein the head of the connecting member is connected to the tool carrier for transmitting the upsetting forces. A feed drive operating essentially in slab feeding direction acts on the tool carrier.

The features described above make it possible to separately control the sequence of movement of the pressing tools for the pressing action for reducing the slabs and for the feeding movement of the pressing tools, so that for any chosen feeding distance, a synchronization of the movement of the pressing tools with the movement of the slab to be pressed laterally is insured. This upsetting press makes possible the continuous reduction of the width of the slab to values predetermined by rolling technology. The sliding bearing between connecting member head and tool carrier and the roller bearings of the eccentric shafts are subjected to high loads and must be constructed as much as possible without mechanical play because of the superimposed reduction and feeding movements of the pressing tools and because of the high pressing forces.

European patent application EP-A-0 224 333 discloses a press for reducing the width of hot slabs in which the tool carrier receiving the pressing tool is moved by a crank drive on both sides against the slab edges. The tool carrier is supported by two parallel struts which are rotatably guided by means of a thread in a transverse member. The struts are rotated by means of a motor through a worm gearing arranged on the outside. The transverse member is connected to an eccentric shaft by means of two connecting members. This construction has the purpose to adjust the distance of the pressing tools from the edges of slabs having different widths without replacing the crank drive composed of eccentric shaft and connecting member. No measures are provided for avoiding the mechanical play occurring in the threaded guiding means or in the bearings of the eccentric shaft. Also, structural features for balancing the pressing forces are not provided.

SUMMARY OF THE INVENTION

Therefore, it is the object of the present invention to further develop the above-described upsetting press, and particularly to provide structural features for clamping tool carriers and crank housing and balancing the crank housing on the upsetting stand, which make it possible to apply load without play and uniformly on the sliding bearings between connecting member head and tool carrier and on the roller bearings in any state of load application to the upsetting press.

In accordance with the present invention, a rod system which is mounted in an articulated manner and is guided through the crank housing acts approximately in the middle on the tool carrier. Spaced from the middle rod system, two outer rod systems are supported in an articulated manner on the crank housing. The middle rod system as well as the outer rod systems are connected to clamping units which can apply tensile loads on the rod systems. The clamping units, in turn, are rigidly connected to the transverse member of the housing post members of the upsetting stand.

As a result of the above-described features, the tool carrier is clamped against the connecting member heads of the crank drive, so that any possibly existing mechanical play in the sliding bearing between connecting member head and tool carrier is removed even in the unloaded phase of movement in which the pressing tool is moved after pressing away from the slab edge. The middle rod system which is clamped to be under tension also causes a certain load to act on the roller bearings of the eccentric shaft of the crank drive, so that any possibly existing mechanical play is also removed from the roller bearings even in the unloaded phase of movement of the pressing tools when these tools are moved away from the slab edge. The features of the present invention further reduce the mechanical noises and prevent a premature wear of the bearings. In addition, the crank housing is tightly clamped against the transverse member of the upsetting stand by means of the outer rod systems and the corresponding clamping units, so that all reaction forces emanating from the pressing procedure are uniformly introduced into the upsetting stand of the press. Also, any play is removed from the mechanical adjusting means, particularly play in the pressure spindle and the pressure bearings.

In accordance with a further development of the invention, the middle rod system has a circular guide means which is movably arranged in the crank housing. A tension rod received in joint eye members is arranged on the tool carrier and the circular guide means. On the other hand, a clamping device acts in an articulated manner on the circular guide means, wherein the clamping device can elastically follow the movement of the tool carrier. The clamping device is in fixed connection with the transverse member of the post members. As a result, the middle rod system can follow the superimposed movements of the pressing tool and of the tool carrier in feeding direction of the slab and in reduction direction which extends perpendicularly to the feeding direction. In addition, the tension forces required for the play-free connection of tool carrier and connecting member head and for the play-free mounting of the eccentric shaft can be absorbed in each position of movement of the pressing tool directly by the transverse member of the housing post.

In accordance with a particularly advantageous development of the invention, the clamping device for the middle rod system is a piston-cylinder unit with pressure reservoir with double application of hydraulic pressure medium. The piston rod of the piston-cylinder unit is mounted in a joint eye member which is provided with a ball socket and is located in the circular guide means. The cylinder of the piston-cylinder unit rests against the transverse member by means of contact element and support plate. As a result, it can be ensured that constant tensile forces are applied to the tool carrier by means of the middle rod system. The pressure reservoir also makes it possible to adjust in a controlled manner the tensile forces to the movement of the pressing tool. It is an advantage that the piston-cylinder unit for the middle rod system includes a control device for the applied tensile forces which is directly dependent on the drive of the crank drive.

For obtaining a problem-free guidance of the middle rod system in the crank housing, it is proposed in accordance with another further development of the invention that the circular guide means is guided in the crank housing in a sliding bushing which preferably can be supplied with a lubricant.

In accordance with another feature of the present invention, particularly for balancing the forces in the structural unit composed of crank housing, crank drive, tool carrier and pressing tool within the upsetting stand of the press, each outer rod system is spaced at an equal distance from the middle rod system and the outer rod system is simultaneously the piston rod of a piston-cylinder unit with double application of hydraulic pressure medium, wherein the piston rod is mounted in a joint eye member which is arranged on the crank housing and is provided with a ball socket, and wherein the cylinder rests against the transverse member by means of contact elements and support plate. As a result, a cardanically acting connection is obtained between the crank housing and the piston rod, so that only tensile forces without bending load components act on the crank housing which is a decisive aspect for obtaining a secure balancing of the forces. Because the middle rod system is attached to the stationary transverse member of the upsetting stand, the mechanical adjustment of the crank housing is balanced already to a great extent. The remaining balancing of the mechanical adjustment is then carried out by the two outer hydraulic cylinders. It is an advantage in this connection that the piston-cylinder unit for each outer rod system includes a control unit which can be actively actuated, wherein balancing of the mechanical adjustment of the crank housing can be carried out by the control unit.

In accordance with another feature of the present invention, the piston-cylinder unit of each outer rod system can be used for displacing the crank housing, the crank drive and at least the tool carrier as a structural unit into an assembly position and a disassembly position. The assembly position and the disassembly position is defined by the arrangement of a rail arrangement on which the structural unit can be moved out of the upsetting stand onto the assembling site, wherein the rail assembly extends between the post members and transversely on a side of the post members. For the purpose of the quick disassembly or assembly of the structural unit, particularly of the crank housing from or with the middle rod system and from or with the two outer rod systems, it is proposed that each joint eye member of the middle rod system and the outer rod system is arranged in a support which can be disconnected from the crank housing preferably by means of pins and bolts.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DESCRIPTION OF THE PREFERRED EMBODIMENT

Figure 1:
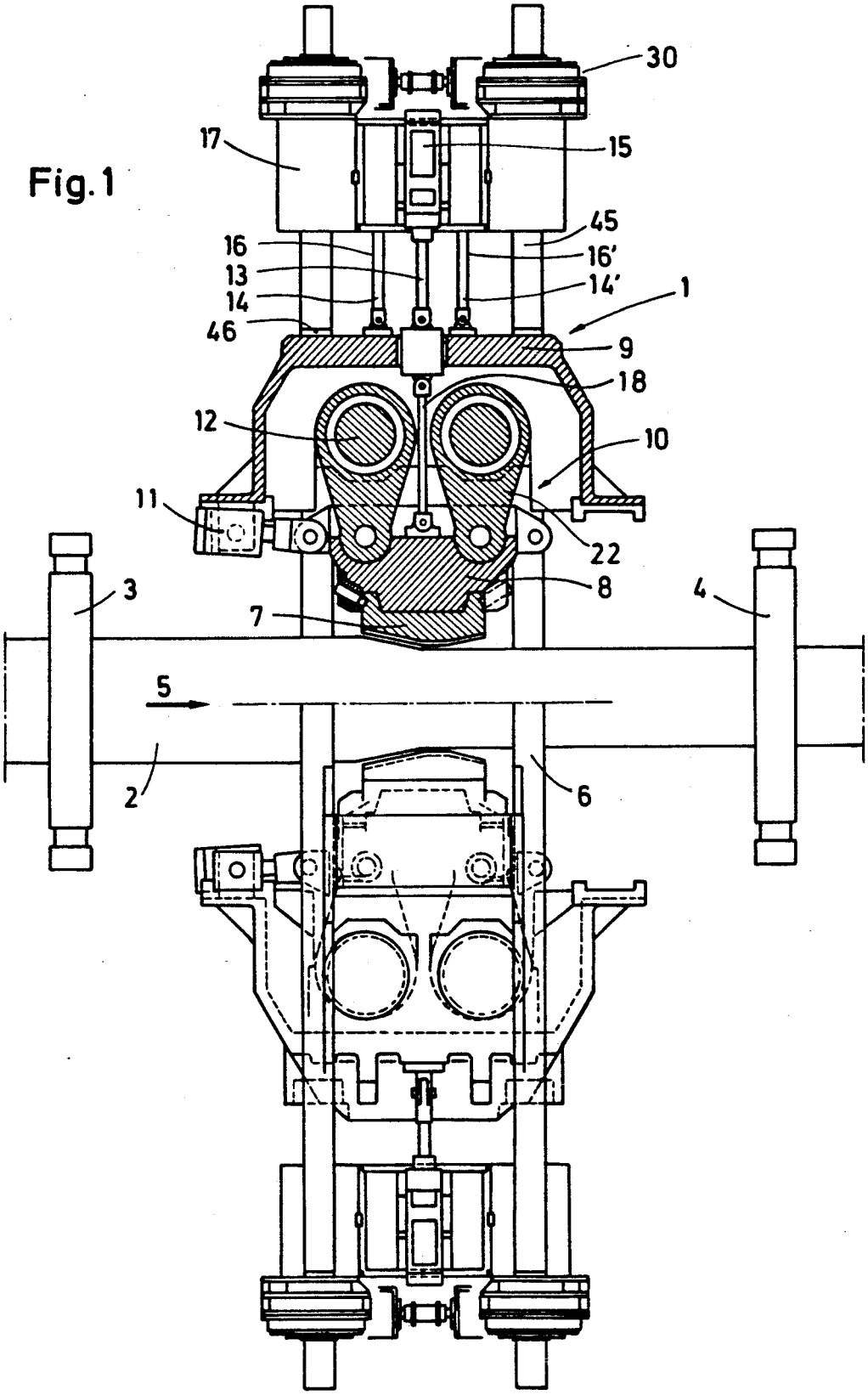
FIG. 1 is a horizontal partially sectional view of an upsetting press.

FIG. 1 of the drawing is a horizontal, partially sectional view of the flying upsetting press 1 for reducing the width of slabs 2 in a hot-rolled wide strip breaking-down train. The slabs are continuously supplied from a slab casting plant, not shown, arranged in front of the upsetting press. Driver rolls 3, 4 are arranged in front of the upsetting press and following the upsetting press, respectively. The slab 2 travels through the slab upsetting stand in the direction of movement indicated by arrow 5 in FIG. 1. The upsetting press includes housing posts 6. A crank housing 9 is adjustably guided between the housing posts in the upsetting stand of the upsetting press.

Pressing tools 7 are arranged in pressing tool carriers 8 on both sides of the slab 2. The pressing tool and the tool carrier include a reduction drive 10 which acts in normal direction, i.e., in a direction extending perpendicularly to the slab 2 and a feeding drive 11 which acts in tangential direction, i.e., in a direction extending parallel to the slab 2. The reduction drive is formed by making each tool carrier 8 movable essentially in the direction of the slab whose width has to be reduced, wherein the tool carrier 8 is movable by means of a lever system which includes two connecting members 22 and is actuated by two eccentric shafts 12. The feeding drive 11 acting essentially in the feeding direction of the slab acts on the tool carrier 8 and is supported on the crank housing 9 in which the two eccentric shafts 12 are mounted.

In order to clamp and balance the pressing tool carrier and crank housing 9 on the upsetting stand 6 of the press 1 and for displacing the structural unit composed essentially of tool carrier 8, crank drive 10 and crank housing 9, a rod system 13 which is mounted in an articulated manner and extends through the crank housing 9 acts on the tool carrier approximately in the middle thereof and two additional outer rod systems 14, 14', also mounted in an articulated manner, act on the crank housing 9 at a distance spaced from the middle rod system 13. The middle rod system 13 and the outer rod systems 14, 14' are connected to clamping units 15, 16 which are capable of applying a tensile load on the rod systems, wherein the clamping units 15, 16, in turn, are fixedly connected to the transverse member 17 of the post members 6 of the upsetting stand 1.

Figure 2:
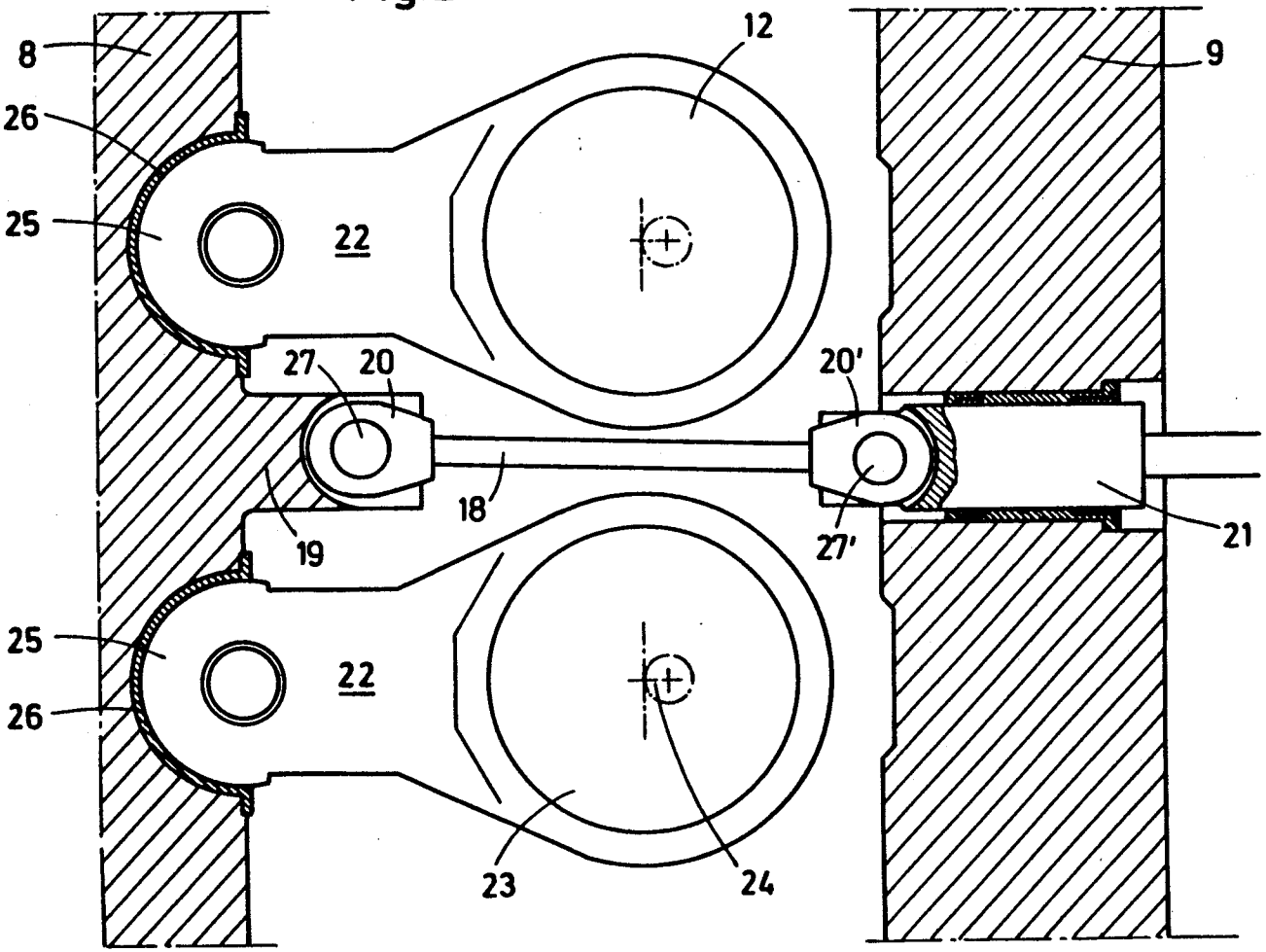
FIG. 2 is a partially sectional view, on a larger scale, of a tension rod mounted between tool carrier and crank housing in joint eye members.

FIG. 2 of the drawing is a partially sectional view showing on a larger scale a detail of the arrangement of the pull rod 18 as a part of the middle rod system. This pull rod 18 is mounted on a projection 19 of the tool carrier 8 in a joint eye member 20. The end of the pull rod is mounted in another joint eye member 20' which is connected to a circular guide means 21 which is arranged longitudinally movably in the crank housing. The pull rod 18 is mounted in the middle between the connecting members 22 which rotate about eccentricity 24 on the eccentric shafts 12 which are mounted on roller bearings, not shown. The connecting member heads 25 are seated in sliding bearing half shells 26 which are formed in the tool carrier 8. The pins 27, 27' in the joint eye members 20, 20' of the pull rod 18 are mounted in a ball socket, not shown. The other end of the circular guide means 21 is provided with another joint eye member 29 which is part of a support 23 which is screwed to the circular guide means.

Figure 3:
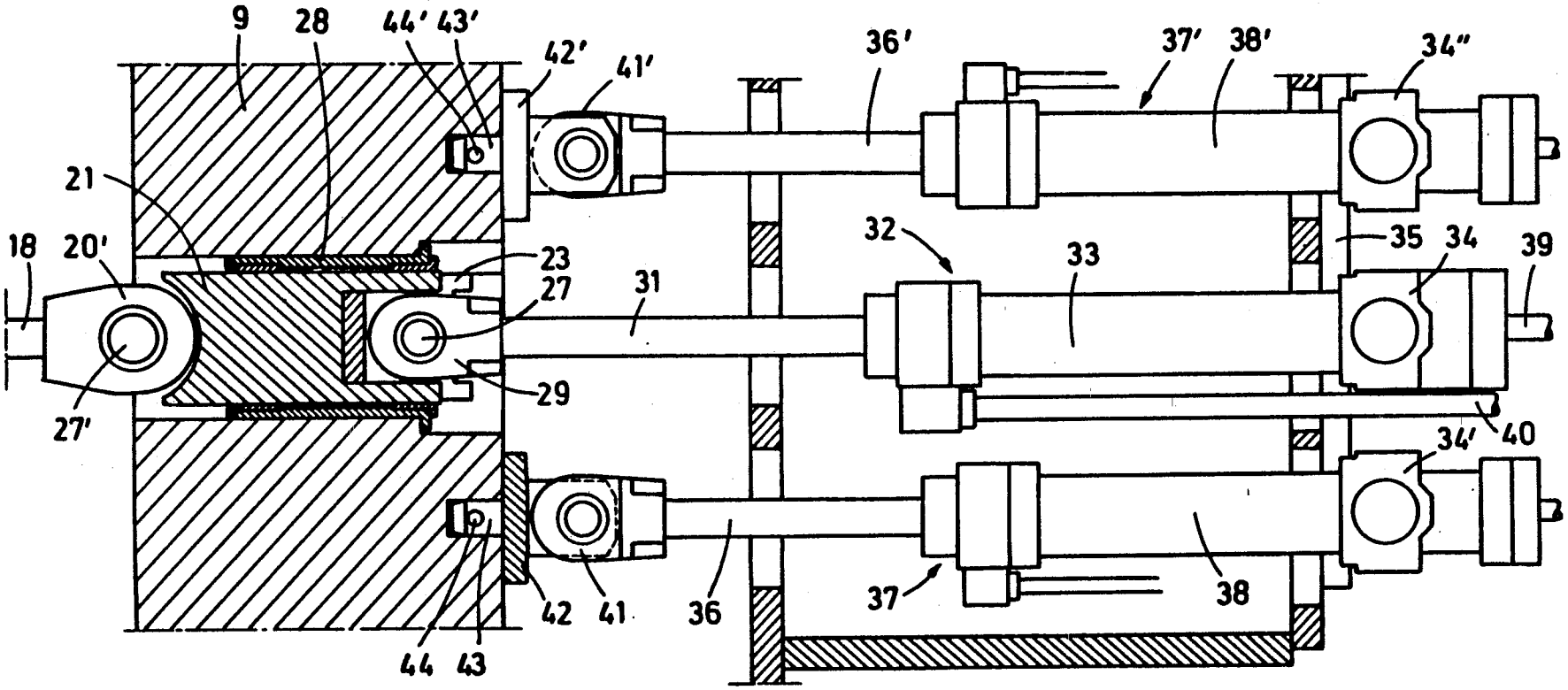
FIG. 3 is a partially sectional view showing the arrangement of middle rod system and outer rod systems between crank housing and transverse member of the upsetting stand.

FIG. 3 of the drawing is a continuation of FIG. 2 and shows the circular guide means 21 arranged in the crank housing. FIG. 3 also shows that the circular guide means is surrounded by a sliding bushing 28 which can be supplied with lubricant. The second portion of the middle rod system 13 is fastened to the joint eye member 29. This second portion simultaneously is the piston rod 31 of a piston-cylinder unit 32 which is provided with a pressure reservoir, not shown, which may be integrated in this unit, for example, as a gas pressure reservoir, not shown. The cylinder 33 of the unit 32 is supported by means of a contact element 34 and a support plate 35 on the transverse member 17.

The transverse member 17 is a welded plate structure in which the piston-cylinder unit 32 is arranged. The tool carrier 8 is pulled toward the rear against the transverse member of the upsetting stand by means of the pull rod 18, the circular guide means 21 and the piston rod 31 and the pressure reservoir of the piston-cylinder unit 32 acts on the tool carrier 8 in the manner of a pretensioned spring. As a result of these structural features, the connecting member heads 25 are guided without play in the sliding bearing half shell and, in addition, the play is removed from the roller bearings of the eccentric shafts 12. Therefore, all bearings are without play. Because of the fastening of the middle rod system 13 on the stationary transverse member 17 of the upsetting stand, the mechanical adjustment 20 of the crank housing is additionally partially balanced. Also, the mechanical play is removed from the pressure spindle 45 and from the pressure bearing 46 of the mechanical adjustment system by means of the outer rod systems.

Balancing of the crank housing 9 is additionally carried out by means of the two outer rod systems 14, 14' which simultaneously are the piston rods 36, 36' of two piston-cylinder units 37, 37' with double application of pressure medium. The cylinders 38, 38' of these units are supported on the transverse member 17 of the upsetting stand by means of the contact elements 34', 34'' and by means of the support plate 35 and are arranged in the plate structure of this transverse member. All piston-cylinder units are provided with a supply line 39 and a discharge line 40 for the pressure medium. The joint eye members 41, 41' of the outer rod systems 14, 14' are arranged in a support 42, 42' which are each releasably connected to the crank housing by means of pins 43, 43' and bolts 44, 44'. The joint eye members 41, 41' of the outer rod systems 14, 14' are cardanically mounted. The piston-cylinder unit for the middle rod system includes a control device, not shown, for the applied tensile forces, wherein the control device is directly dependent on the drive of the crank drive. Also not shown in the drawing is each actively operated control device for balancing the mechanical adjustment of the crank drive provided for each outer rod system and the corresponding piston-cylinder unit.

When the structural unit composed essentially of tool carrier 8, crank drive 10 and crank housing 9 is to be moved out of the housing post of the upsetting press, this structural unit is initially displaced by the piston-cylinder units 37, 37' of the outer rod system 14, 14' into a disassembly position X after the middle rod system has previously been separated from the circular guide means. The assembly or disassembly position X is defined by the position of the rail arrangement on which this structural unit is to be moved transversely of the longitudinal axis of the upsetting press to an assembly site. In the assembly or disassembly position X, the bolts 44, 44' are removed from the pins 43, 43' of the support 42, 42', so that the structural unit consisting essentially of crank housing, crank drive and tool carrier is separated from the middle rod system and the two outer rod systems and, thus, is freely movable in transverse direction.

The features described above result in an arrangement which in a surprising manner carries out several functions simultaneously, i.e., the adjustment of the pressing tools to the different widths of the slab, clamping and balancing of the pressing tool carrier and the crank housing in the upsetting stand of the upsetting press and the assembly and disassembly of crank housing, crank drive and tool carrier. It is within the scope of the invention to carry out clamping and balancing only by means of a middle rod system. However, this is a less advantageous solution.

While a specific embodiment of the invention has been shown and described in detail to illustrate the application of the inventive principle, it will be understood that the invention may be embodied otherwise without departing from such principles.

I claim:

1. An arrangement for clamping and balancing a pressing tool carrier and a crank housing of an upsetting press, for width reduction of rolled material, and particularly for reducing the widths of slabs in hot-rolled wide-strip breaking-down trains by feeding said slabs through the upsetting press as said pressing tool carriers are reciprocated towards and away from said slabs, comprising:

a tool carrier for receiving pressing tools which are arranged on both sides of said slab, wherein said tool carrier is movable in a direction of a slab reduction by means of a crank drive, wherein the arrangement further comprises:

a crank housing for said tool carrier, said crank housing having said crank drive;

an upsetting stand comprising:

housing post members and a transverse member connecting said housing post members, said crank housing and its crank drive being movably mounted on and arranged between said housing post members and said transverse member;

a middle rod system mounted in an articulated manner and guided through said crank housing and attached to said tool carrier approximately in the middle thereof;

a plurality of outer rod systems which are spaced from said middle rod system wherein said outer rod system are mounted in an articulated manner and attached to said crank housing, wherein said middle rod system and said outer rod system are connected to clamping units for applying a tensile load to said middle rod system and said outer rod systems, and further wherein said clamping units are rigidly connected to said transverse member of said housing post members of said upsetting stand, said tensile forces acting on said outer rod systems to move said crank housing relative to said transverse member in a direction away from said slab and sand tensile force acting on said middle rod system to reduce any mechanical play between the tool carrier and the crank drive during slab width reduction.

2. The arrangement of claim 1, wherein said middle rod systems further comprises:

a circular guide means movably arranged in said crank housing;

a tension rod received in joint eye members and arranged on said tool carrier and a circular guide means; and a clamping device attached in an articulated manner to said circular guide means, wherein said clamping device can elastically follow a movement of said tool carrier, and further wherein said clamping device is in fixed connection with said transverse member of said post members.

3. The arrangement of claim 2, wherein said clamping device for said middle rod system is a piston-cylinder unit with a pressure reservoir with double application of hydraulic pressure medium, and further wherein said piston-cylinder unit includes a piston rod which is mounted in a joint eye member, wherein said joint eye member is provided with a ball socket and is located in said circular guide means, and further wherein said piston-cylinder unit further comprises:

a cylinder which rests against said transverse member by means of contact elements and support plates.

4. The arrangement of claim 3, wherein said circular guide means is guided in the crank housing in a sliding bushing with a lubricant supply means.

5. The arrangement of claim 3, wherein said piston-cylinder unit for said middle rod system further comprises:

a control device for applied tensile forces, wherein said control device is directly dependent on a drive of a crank drive.

6. The arrangement of claim 1, wherein each of said outer rod systems is spaced at an equal distance from said middle rod system, and further wherein each outer rod system is a piston rod of a piston-cylinder unit having a double application of hydraulic pressure medium, and further wherein said piston rod is mounted in a joint eye member which is arranged on said crank housing and is provided with a ball socket, and wherein a cylinder of said piston-cylinder unit rests against a transverse member by means of contact elements and supports plates.

7. The arrangement of claim 6, wherein each piston-cylinder unit for said outer rod systems further comprise:

a control unit which can be actively actuated for balancing a mechanical adjustment of said crank housing.

8. The arrangement of claim 6, wherein said joint eye member of said middle rod system and of said outer rod systems are arranged in a support means and releasably mounted in said crank housing by means of pins and bolts.

9. The arrangement of claim 6, wherein one of said crank housing and said crank drive and said tool carrier is displaceable as a structural unit into a disassembly and assembly position by means of said piston-cylinder unit of each outer rod system.

* * * * *